United States Patent [19]

Nagase

[11] 4,103,466

[45] Aug. 1, 1978

[54] BAY WINDOW UNIT

[75] Inventor: Mitsuo Nagase, Kurobe, Japan

[73] Assignee: Yoshida Kogyo K.K., Tokyo, Japan

[21] Appl. No.: 759,485

[22] Filed: Jan. 14, 1977

[30] Foreign Application Priority Data

Jan. 17, 1976 [JP] Japan ..... 51/4129[U]

[51] Int. Cl.[2] ..... E06B 1/38

[52] U.S. Cl. ..... 52/201; 52/73

[58] Field of Search ..... 52/73, 74, 201; 160/88; 47/40, 68

[56] References Cited

U.S. PATENT DOCUMENTS

| | | | |
|---|---|---|---|
| 1,152,899 | 9/1915 | Moore | 52/201 X |
| 2,074,872 | 3/1937 | Thorin | 47/40 |
| 2,834,415 | 5/1958 | Mims | 52/73 |
| 3,100,012 | 8/1963 | Dunn | 52/74 X |
| 3,227,206 | 1/1966 | Rocco et al. | 52/201 X |
| 3,800,470 | 4/1974 | Kleine | 47/40 X |
| 4,009,546 | 3/1977 | Buck, Jr. | 52/201 |

FOREIGN PATENT DOCUMENTS

| | | | |
|---|---|---|---|
| 16,509 | 10/1928 | Australia | 52/201 |

*Primary Examiner*—Leslie Braun

*Attorney, Agent, or Firm*—Hill, Gross, Simpson, Van Santen, Steadman, Chiara & Simpson

[57] ABSTRACT

A bay window unit is adapted to cover an opening in a building wall. An overhanging roof decking structure has a vertical first mounting portion at its inner end adapted to be fixedly secured to a fixed header in the building wall, a second mounting portion at its outer end, and a downwardly facing third mounting portion disposed intermediate the first and second mounting portions. A generally horizontally extending bracket member has its inner end secured to an exterior vertical surface of a fixed sill in the building wall. A frame of an exterior window assembly is disposed at the outer ends of the roof decking structure and the bracket member. A frame header is fixedly secured to the second mounting portion, and a frame sill rests on and is fixedly secured to the outer end of the bracket member.

11 Claims, 1 Drawing Figure

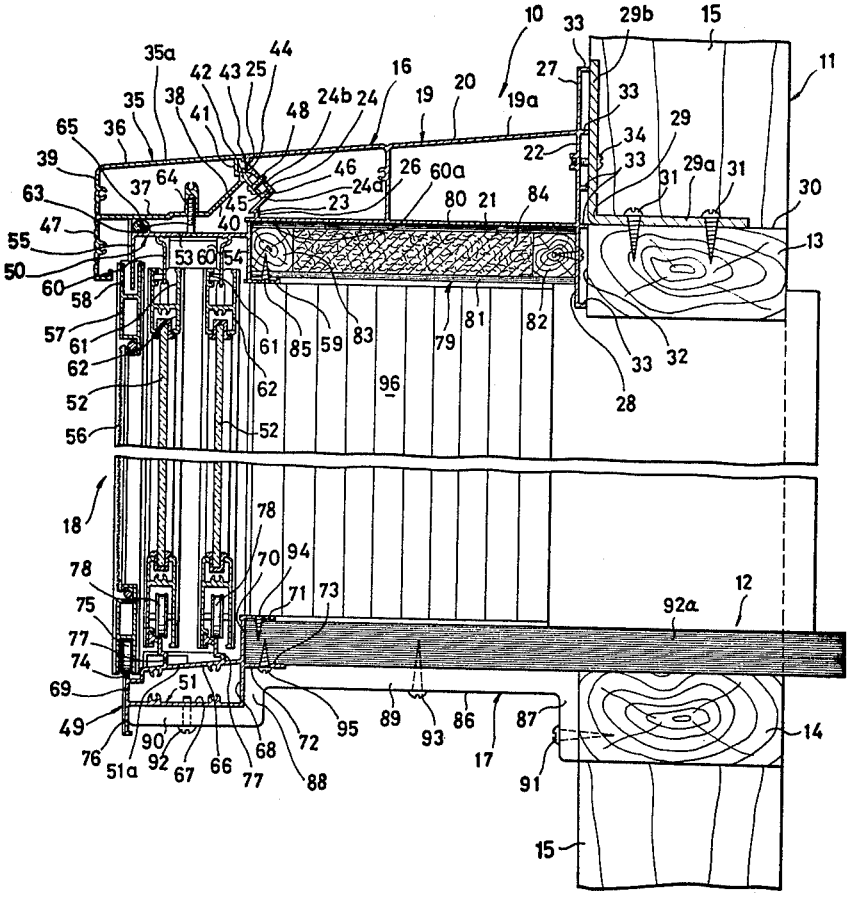
10
33
29b
15
11
35a
44
42
43
25
16
27
33
19
20
19a
35
38
41
48
24b
24
34
29
65
36
22
33
39
46
26
60a
29a
31
31
63
37
64
24a
45
23
80
21
84
30
47
40
13
55
53
60
54
50
60
58
57
61
85
59
83
79
81
82
33
32
61
62
62
96
28
52
56
52
18
78
94
70
78
71
73
12
75
92a
77
74
51
69
49
95
89
93
86
87
14
76
51a
90
92
67
66
68
72
77
88
17
91
15

BAY WINDOW UNIT

BACKGROUND OF THE INVENTION

1. Field of the Invention

This invention relates to a bay window unit of the prefabricated type.

2. Prior Art

The prior bay window units have generally been comprised predominantly of wooden structural members and hence were not fully adaptable for prefabrication. This resulted in increased cost of installation of these conventional bay window units.

SUMMARY OF THE INVENTION

It is therefore an object of this invention to provide a bay window unit which is prefabricated predominantly of extruded metal such as aluminum for easy and quick installation on arrival at the construction site.

According to the invention, there is provided a bay window unit for covering an opening in a building, said opening having a first header and a first sill, the bay window unit comprising: an overhanging roof decking structure for extending along the length of the first header, said structure having a vertical mounting portion at its inner end adapted to be fixedly secured to the first header, a second mounting portion at its outer end, and a downwardly facing third mounting portion lying between said first and second mounting portions; a generally horizontally extending bracket member for extending along the length of the first sill, said bracket member having its inner end secured to an exterior surface of the first sill, said bracket member extending outwardly generally the same distance as said roof decking structure; an exterior window assembly comprising a frame including a second header and a second sill, and a pair of sashes mounted within said frame in parallel closely spaced planes, said frame being disposed at the outer ends of said roof decking structure and said bracket member, said second header being fixedly secured to said second mounting portion, and said second sill resting on and being fixedly secured to the outer end of said bracket member; a pair of side board assemblies extending between said roof decking structure and said bracket member at their opposite sides; and a head board assembly attached to said third mounting portion.

Many other advantages and features of the present invention will become manifest to those versed in the art upon making reference to the detailed description and the accompanying sheet of drawing in which a preferred structural embodiment incorporating the principles of the present invention is shown by way of example.

BRIEF DESCRIPTION OF THE DRAWING

The drawing is a vertical cross-sectional view through a bay window unit constructed in accordance with the present invention.

DETAILED DESCRIPTION OF THE PREFERRED EMBODIMENT

The drawing shows a bay window unit 10 mounted on the exterior of a building wall 11 and covering an opening 12 therein. The building wall 11 includes a pair of horizontally extending wooden head and sill members 13, 14 mounted in the opening 12, and extending between and fixedly supported by a pair of adjacent columns 15. The bay window unit 10 comprises an overhanging roof decking structure 16 projecting outwardly from the wooden header 13, a supporting bracket member 17 projecting outwardly from the wooden sill 14, and a window assembly 18 supported between the roof decking structure 16 and the bracket member 17 at their outer ends.

The overhanging roof decking structure 16 extends along the length of the wooden header 13 and comprises a first structural member 19 including a hollow body **19*a* of generally rectangular cross-sectional shape having a pair of upper and lower plates 20, 21 and a pair of inner and outer end plates 22, 23 interconnecting the upper and lower plates 20, 21 at their inner and outer ends or edges, respectively, the first structural member 19 being made of extruded aluminum. The upper plate 20 is slanted downwardly toward its outer end or edge, and the lower plate 21 is horizontally disposed. The inner end plate 22 extends substantially at a right angle to the lower plate 21, and the outer end plate 23 has an intermediate right-angular portion 24 interconnecting a pair of upper and lower vertical web portions 25, 26. A pair of upper and lower integral vertical flanges 27, 28 extend upwardly and downwardly from the inner end plate 22 at its upper and lower ends or edges, respectively, in coplanar relationship so that the inner end plate 22 and the pair of flanges 27, 28 jointly provide a flat vertical exterior surface of the roof decking structure 16. The first structural member 19 is fixedly secured to the wooden header 13 by means of a bracket or structural bar 29 of L-shaped cross section extending along the length of the wooden header 13. The L-shaped bracket 29 may be replaced by a plurality of brackets of identical cross section but of substantially shorter length adapted to be mounted to and spaced along the length of the header 13. The L-shaped bracket 29 has one leg 29*a* mated with and secured to the top surface 30 of the wooden header 13 by a pair of series of screws 31, 31 passing through the leg 29*a* into the header 13 such that the outer surface of the other leg 29*b* of the L-shaped bracket 29 lies substantially flush with the exterior vertical surface 32 of the wooden header 13. The first structural member 19 has a plurality of spacer ribs 33 formed on the pair of flanges 27, 28 and the inner end plate 22 for abutment against the outer surface of the other leg 29*b* of the L-shaped bracket 29 and the exterior vertical surface 32 of the header 13. Connection between the first structural member 19 and the wooden header 13 is made by means of a series of screws 34 passing through the other leg 29*b* of the L-shaped bracket into the inner end plate 22**.

The overhanging roof decking structure 16 also comprises a second structural member 35 including a hollow body **35*a* of generally rectangular cross section having a pair of upper and lower plates 36, 37 and a pair of inner and outer end plates 38, 39 interconnecting the upper and lower plates 36, 37 at their inner and outer ends or edges, respectively, the second structural member 35 being made of extruded aluminum. The upper plate 36 is so slanted downwardly and outwardly as to lie in coplanar relationship to the first-mentioned slanted upper plate 20, and the lower plate 37 is disposed horizontally. The inner end plate 38 has an inclined lower portion 40 extending substantially parallel to the lower leg 24*a* of the angle portion 24 and an upper vertical web portion 41. A corner 42 into which the web portion 41 and the inclined portion 40 merge is formed into a thickened cross-sectional shape, the thickened corner 42** having a generally inwardly facing recess 43 which is complementary in contour to a corner 44 into which the upper web 25 and the upper leg 24*b* of the angle portion 24 merge. Extending from the thickened corner 42 in parallel spaced relationship to the upper leg 24*b* of the angle portion 24 is an inclined flange 45 which has its lower or distal end portion directed upwardly and inwardly to provide an engaging fin 46. The second structural member 35 has an outer vertical flange 47 formed integrally with and extending downwardly from the outer end plate 39 in coplanar relationship thereto so that the outer end plate 39 and the flange 47 jointly provide a flat vertical exterior surface of the roof decking structure 16. The second structural member 35 is fixedly secured to the first structural member 19 by means of a series of screws 48 passing through the inclined flange 45 and the upper leg 24*b* of the angle portion 24, with the corner 44 mating with the complementary recess 43, and with the engaging fin 46 in abutting engagement with the lower leg 24*a* of the angle portion 24, the inner edge of the upper plate 36 being held in abutment against the outer edge of the first-mentioned upper plate 20.

The exterior window assembly 18 comprises a frame 49 made of extruded aluminum and including a header 50, a sill 51 and a pair of jambs (not shown) interconnecting the header 50 and sill 51 at their respective opposite ends to define a generally rectangular opening in which a pair of relatively movable sashes 52, 52 of the rolling type are mounted in parallel closely spaced planes. The frame header 50 includes a horizontal base plate 53 and a pair of inner and outer longitudinal vertical flanges 54, 55 between which the base plate 53 lies. An upwardly opening guide channel 58 of a top rail 57 of a screen sash 56 receives the lower portion of the outer flange 55. The upper end or edge of the inner flange 54 extends beyond the base plate 53 for abutting engagement with the first-mentioned lower plate 21 immediately adjacent to its outer edge. Formed integrally with and extending inwardly from the inner vertical flange 54 at its lower end is a horizontal flange 59 which defines together with the inner vertical flange 54 and the outer marginal portion of the lower plate 21 an inwardly facing channel section 60*a*. The base plate 53 has a pair of spaced apart, downwardly extending rails 60, 60 disposed between the inner and outer vertical flanges 54, 55 for being received in their respective upwardly opening guide channels 61, 61 of the top rails 62, 62 of the sashes 52, 52. The frame header 50 is fixedly secured to the roof decking structure 16 by means of a series of screws 63 passing through the base plate 53 between the rails 60, 60 and threadedly received in a corresponding number of socket portions 64 formed on the lower plate 37 of the second structural member 35. An elongated sealing element 65 made for example of air-impermeable rubber is interposed between and retained by the lower plate 37 and the base plate 53 adjacent to the outer vertical flange 55.

The frame sill 51 includes a hollow body 51*a* of generally rectangular cross section having a pair of upper and lower plates 66, 67 and a pair of inner and outer connecting plates 68, 69 interconnecting the upper and lower plates 66, 67 at their inner and outer edges, respectively. The upper plate 66 is slanted downwardly and outwardly and stepped adjacent to its outer edge, and the lower plate 67 is disposed horizontally. Extending upwardly from the inner connecting plate 68 at its upper edge is an integral vertical plate 70 which in turn has an integral horizontal flange 71 extending inwardly from its upper end. Also projecting inwardly from the inner connecting plate 68 at its upper edge is another horizontal flange 72. The pair of flanges 71, 72 and the vertical plate 70 jointly provide an inwardly opening channel portion 73. The outer connecting plate 69 has its upper and lower edges extended beyond the upper and lower plate 66, 67 to provide respectively a rail 74, on which rollers 75 of the screen sash ride to permit the screen sash 56 to move therealong, and a vertical flange 76 covering the outer edge of the bracket member 17. The upper plate 66 has a pair of spaced apart, stepped rails 77, 77 on which respective rollers 78, 78 of the relatively movable sashes 52, 52 are disposed in rolling engagement for horizontal movement therealong.

The roof decking structure 16 also supports a head board assembly 79 which includes a pair of parallel spaced apart upper and lower panel members 80, 81. The upper panel member 80 is mated with the undersurface of the lower plate 21 with its inner and outer ends in abutment respectively against the lower vertical flange 28 and the vertical flange 54. Similarly, the lower panel member 81 has its inner and outer ends disposed in abutment respectively against the lower vertical flange 28 and the vertical flange 54, with its outer lower marginal portion held against and supported by the horizontal flange 59. A pair of elongated inner and outer wooden attachment members 82, 83 of substantially square cross section are interposed between the upper and lower panel members 80, 81 at their respective inner and outer ends, with their oppositely facing interior and exterior surfaces mated respectively with the lower vertical flange 28 and the vertical flange 54. A filling core 84 of a sound-absorbing material is inserted in an enclosed space defined by the upper and lower panel members 80, 81 and the inner and outer attachment members 82, 83. The filling core 84 serves to prevent the sound produced by the rain beating against the upper plate 20 of the first structural member 19 from penetrating into the interior of the bay window unit 10. The lower panel member 81 has its outer end fastened to the outer attachment member 83 by a series of screws 85 passing through the horizontal flange 59 and the lower panel member 81 into the outer attachment member 83.

The supporting bracket member 17 extends along the length of the wooden sill 14, and includes a major portion 86 of inverted channel-shaped cross section having a pair of inner and outer vertical arms 87, 88 and a horizontal base 89 extending therebetween, and a horizontal end portion 90 extending outwardly from the outer vertical arm 88 at its lower end. The bracket member 17 is fixedly secured to the exterior vertical surface of the wooden sill 14 by means of a series of screws 91 passing through the inner vertical arm 87 into the wooden sill 14, with the upper surface of the base 89 lying flush with the top surface of the wooden sill 14. The frame sill 51 is supported by the bracket member 17 in such a manner that the lower horizontal plate 67 rests on and is fixedly secured to the end portion 90 by means of a series of screws 92 passing therethrough, with the inner connecting plate 68 mated with the exterior surface of the outer arm 88 and with the outer edge of the end portion 90 in engagement with the outer vertical flange 76.

A seat board 92*a* is placed on a continuous surface defined by the upper surface of the base 89 and the top surface of the wooden sill 14 and fixedly held relatively to the wooden sill 14 by means of a series of screws 93 passing through the base 89 into the seat board 92*a*, the outer edge of the seat board 92a being snugly received in the channel portion 73 and fixedly secured thereto by a pair of series of screws 94, 95 passing respectively through the horizontal flanges 71, 72 into the seat board 92a.

A pair of side board or panel structure 96, only one of which is shown in the drawing, extend vertically between the roof decking structure 16 and the bracket member 17 at opposite sides thereof, respectively.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A bay window unit for covering an opening in a building, said opening having a first header and a first sill, the bay window unit comprising:

(a) a mounting member of L-shaped cross section, one leg of said mounting member being adapted to be fixedly secured to a top surface of the first header;

(b) an overhanging roof decking structure for extending along the length of the first header, said structure being adapted to project outwardly from the first header, said structure including a hollow body of generally rectangular cross section having a pair of generally horizontal upper and lower plates and a pair of vertical inner and outer end plates interconnecting said upper and lower plates at their inner and outer ends, respectively, said structure having a vertical first mounting portion at its inner end adapted to be fixedly secured to the first header, said vertical first mounting portion including said inner end plate fixedly secured to the other leg of said mounting member, and a first vertical flange extending from said inner end plate at its lower edge and adapted to be held against the exterior vertical surface of said first header, said roof decking structure including a second mounting portion at its outer end, and a downwardly facing third mounting portion disposed intermediate said first and second mounting portions;

(c) a generally horizontally extending bracket member for extending along the length of the first sill, said bracket member being adapted to have its inner end secured to an exterior vertical surface of the first sill, said bracket member extending outwardly generally the same distance as said roof decking structure;

(d) an exterior window assembly comprising a frame including a second header and a second sill, and a pair of sashes mounted within said frame in parallel closely spaced planes, said frame being disposed at the outer ends of said roof decking structure and said bracket member, said second header being fixedly secured to said second mounting portion, and said second sill resting on and being fixedly secured to the outer end of said bracket member;

(e) a pair of side board structures extending between said roof decking structure and said bracket member at their opposite sides; and (f) a head board assembly attached to said third mounting portion, the inner end of said head board assembly being held against and secured to the exterior surface of said first vertical flange.

2. A bay window unit according to claim 1, in which said second header includes an inner vertical plate and a first horizontal flange extending inwardly from said vertical plate at its lower end, said vertical plate being disposed in engagement with said lower horizontal plate at its upper end and defining together with said first horizontal flange and said lower horizontal plate, an inwardly opening channel-shaped section into which the outer end of said head board assembly is received.

3. A bay window unit for covering an opening in the building, said opening having a first header and a first sill, the bay window unit comprising:

(a) an overhanging roof decking structure for extending along the length of the first header, said structure being adapted to project outwardly from the first header and having a first vertical mounting portion at its inner end adapted to be fixedly secured to the first header, a second mounting portion at its outer end, and a downwardly facing third mounting portion disposed intermediate said first and second mounting portions, said roof decking structure comprising a pair of inner and outer hollow structural members of generally rectangular cross section having respective flat upper portions joined together at their confronting ends to provide a continuous upper surface of said roof decking stucture, the lower portion of said inner structural member defining said third mounting portion at its lower portion, and said outer structural member defining said second mounting portion at its lower portion;

(b) a generally horizontally extending bracket member for extending along the length of the first sill, said bracket member being adapted to have its inner end secured to an exterior vertical surface of the first sill, said bracket member extending outwardly generally the same distance as said roof decking structure;

(c) an exterior window assembly comprising a frame including a second header and a second sill, and a pair of sashes mounted within said frame in parallel closely spaced planes, said frame being disposed at the outer ends of said roof decking structure and said bracket member, said second header being fixedly secured to said second mounting portion, and said second sill resting on and being fixedly secured to the outer end of said bracket member;

(d) a pair of side board structures extending between said roof decking structure and said bracket member at their opposite sides; and (e) a head board assembly attached to said third mounting portion.

4. A bay window unit for covering an opening in a building wall, said opening having a first header and a first sill, the bay window unit comprising:

(a) a roof decking structure having a mounting portion at its inner end, said mounting portion including a vertical face having means by which it may be directed toward the outside of the first header and from which said structure projects outwardly along the length of the header;

(b) an elongated L-shaped bracket having a vertical leg to which a portion of said vertical face is secured, and having a horizontal leg for overlying and engaging said first header for being directly supported from below by such header;

(c) a single bracket member having a vertical surface having means by which it may be securely directly to an exterior vertical surface of the first sill, said single bracket member having such length and width as to underlie substantially the entire outwardly projecting extent of said roof decking structure;

(d) enclosing means extending from the projecting periphery of said roof decking structure to the projecting periphery of said single bracket member, and including at least one window; and (e) a separate second sill secured to the outermost marginal portion of said single bracket, and supporting said window from below.

5. A bay window unit according to claim 4 including a seat board disposed on said single bracket member, the outer edge of said seat board being fixedly secured to said second sill, said seat board having such extent as to enable it to project through the wall opening, whereby said seat board is supported by said bracket and said second sill as a cantilever.

6. A bay window unit for covering an opening in a building, said opening having a first header and a first sill, the bay window unit comprising:

(a) an overhanging roof decking structure for extending laterally along the length of the first header, said roof decking structure having a vertical first mounting portion at its inner end having means by which it may be fixedly secured to and supported by the first header, and said structure projecting outwardly from said vertical portion to a second mounting portion disposed at its outer end, and a downwardly facing third mounting portion extending horizontally outwardly from said first and to said second mounting portion;

(b) a bracket member having a length for extending laterally along the length of the first sill, said bracket member having an inner vertical mounting end having means by which it may be secured to an exterior vertical surface of the first sill, said bracket member extending generally horizontally outwardly from its inner mounting end to its outer end by a distance which is generally the same as the distance that said roof decking structure projects from its inner end to its outermost end;

(c) a fixed window frame including a second header extending along its upper edge and fixedly secured to the lower side of said second mounting portion, and a second sill resting on and being fixedly secured to said outer end of said bracket member;

(d) a pair of sashes mounted within said fixed window frame in parallel closely spaced planes below said second header and above said second sill and both sashes being supported by said second sill;

(e) a pair of side board structures extending between said roof decking structure and said bracket member at their opposite sides; and (f) a head board assembly attached to and underlying said third mounting portion.

7. A bay window unit according to claim 6, in which said bracket member includes a major integral portion of inverted channel-shaped cross-section defined by a pair of inner and outer vertical arms and a horizontal base extending therebetween, and a horizontal end portion extending outwardly from said outer arm at its lower end, said inner vertical mounting end being said inner arm.

8. A bay window unit according to claim 6, in which said head board assembly comprises a pair of rigid upper and lower panel members, and a filling core of sound-absorbing material extending between and having its opposite surfaces covered fully by said upper and lower panel members, the upper surface of the panel being in flatwise engagement with the lower surface of said third mounting portion.

9. A bay window unit according to claim 7, in which said second sill includes a horizontal lowermost portion resting on and fixedly secured to the upper surface of said horizontal end portion of said bracket and an inner vertical end portion mated with the exterior surface of said outer arm of said bracket.

10. A bay window unit according to claim 9, said second sill including means defining an inwardly opening second channel portion projecting upwardly from said inner vertical end portion, and a seat board, the uppermost surface of said bracket member being adapted to lie flush with the top surface of the first sill to provide part of a continuous flat surface on which said seat board is disposed with its outer end received in said inwardly opening second channel portion.

11. A bay window unit according to claim 9, said second sill including an inwardly opening second channel portion having a pair of upper and lower horizontal spaced flanges and extending upwardly from said inner vertical end portion, and a seat board, said lower flange being provided between said seat board and said base of said bracket member, the upper surface of said base of said bracket member being adapted to lie flush with the top surfaces of the first sill and the lower flange to provide part of a continuous flat surface on which said seat board is disposed with its outer end received in said inwardly opening second channel portion.

* * * * *